United States Patent [19]

Lopata et al.

[11] Patent Number: 5,052,949

[45] Date of Patent: Oct. 1, 1991

[54] SHIELDED ELECTRICAL CONNECTOR

[75] Inventors: John E. Lopata, Naperville, Ill.; James Smith, York, Pa.

[73] Assignee: Molex Incorporated, Lisle, Ill.

[21] Appl. No.: 626,148

[22] Filed: Dec. 13, 1990

[51] Int. Cl.[5] ..... H01R 13/648; H01R 13/502

[52] U.S. Cl. ..... 439/610; 439/687

[58] Field of Search ..... 439/98, 465–467, 439/607, 610, 687, 696, 701

[56] References Cited

U.S. PATENT DOCUMENTS 3,550,066 12/1970 Cootes ..... 439/696
4,549,780 10/1985 Bertini et al. ..... 439/465
4,781,614 11/1988 Ahroni ..... 439/696

FOREIGN PATENT DOCUMENTS 2310366 9/1974 Fed. Rep. of Germany ..... 439/465

*Primary Examiner*—Gary F. Paumen
*Attorney, Agent, or Firm*—Louis A. Hecht; Stephen Z. Weiss; Charles S. Cohen

[57] ABSTRACT

A shielded electrical connector assembly which includes an insulating housing having a front mating end and a rear conductor receiving end. A stamped and formed metal shield surrounds at least the rear conductor receiving end of the insulating housing. The shield is formed by a pair of interengaging shield halves. Each shield half has a semicylindrical portion projecting from the rear end thereof and combining with the other shield half to form a cable crimping barrel. The barrel is formed by metal of each shield half being folded rearwardly from a front end thereof, through an opening in the rear end thereof, and thereby being integral with the remainder of the respective shield half. The insulating housing is formed by two interengaging housing halves defining a conductor receiving opening at the rear conductor receiving end of the housing. Interengaging beams are provided on the housing halves on opposite sides of the opening to provide lateral support for a cable and interengaging support for the housing halves themselves.

21 Claims, 2 Drawing Sheets

SHIELDED ELECTRICAL CONNECTOR

FIELD OF THE INVENTION

This invention generally relates to the art of electrical connectors and, particularly, to an electrical connector which has a shield assembly including an integral cable clamping means or crimp barrel.

BACKGROUND OF THE INVENTION

There is an ever increasing demand for effective electrical shielding of electrical connectors in view of the continuing complexity and miniaturization of communication devices which are affected by electromagnetic and radio frequency interference.

Such shielded connectors must be capable of manufacture and assembly with economical methods which are capable of adaptation to standardized connector configurations and sizes. Most such connectors include shield means which are readily stamped and formed from metal material complementary in shape to the profile of the shielded connector components. An example of a standardized connector configuration is a D-sub connector.

Furthermore, such shielded connectors are interengaged with a multiconductor electrical cable which, itself, has shielding means such as a braided shield inside an outer insulating jacket of the cable. The shield of the cable should be conductively coupled to the shield means of the connector. This most often is carried out by cable clamping means, such as a metal crimp barrel which is crimped onto the shielding braid of the cable. For economic manufacture and assembly purposes, the crimp barrel often is formed integral with the stamped and formed shield means of the connector, at a rear end thereof.

Whereas the shield means for the electrical connector is stamped and formed from metal material, heretofore the crimp barrel most often has been formed by a drawing process or at least partially drawn. There are distinct disadvantages of having a drawn portion of a shielding component of an electrical connector. First, the drawing process requires a thicker sheet of metal since drawing tends to thin the metal at the drawn areas. Second, the drawing process usually requires a triangular rather than a rectangular shape of the shielding component. In other words, the rear end of the shielding means angles toward the crimped cable on both sides thereof. When the connector components are overmolded with plastic material, the triangular shape requires the rectangular plastic overmold to fill large voids created by the tapered rear end of the shield. Third, a drawn crimp barrel is stiffer at the interface between the barrel and the rear end of the shield. Therefore, the actual crimping portion of the barrel usually is located rearwardly of the stiffer area of the barrel, requiring that the barrel be of an undue length. This is disadvantageous where miniaturization is a premium. In instances where there are size or envelope limitations, the drawn barrel provides a smaller transition section which makes the routing of the conductors between the terminals (often insulation displacement terminals) and the barrel more difficult.

This invention is directed to solving the above problems by providing a shield means with a new and improved stamped and formed cable clamping means or crimp barrel.

SUMMARY OF THE INVENTION

An object, therefore, of the invention is to provide a new and improved shielded electrical connector which has an improved cable clamping means.

In the exemplary embodiment of the invention, the shielded electrical connector assembly includes an insulating housing means having a front mating end, a rear conductor receiving end and conductor receiving means for receiving conductors from a multiconductor cable projecting from the rear end of the housing means. Stamped and formed metal shield means are disposed about at least the rear conductor receiving end of the insulating housing. Stamped and formed cable clamping means are provided at a rear end of the metal shield means, integral therewith, and formed by metal of the shield means being folded rearwardly from a point remote from the rear end thereof.

As disclosed herein, the metal shield means is provided by a pair of interengageable shield halves each having a metal portion folded rearwardly and combining to form the cable clamping means, preferably in the form of a generally cylindrical crimp barrel. The shield halves each have a front end, and the rearwardly folded metal portion which forms the crimp barrel is folded rearwardly from a front edge of the respective shield half, overlapping a major wall of the shield half and projecting rearwardly through an opening in a rear wall of the shield half.

The insulating housing means of the connector assembly also is fabricated by a pair of interengaging housing halves. Rear walls of the halves have openings or recesses through which the conductors of the cable extend. A feature of the invention is to provide transversely projecting portions of each housing half interengageable with complementary projecting portions of the other half, on opposite sides of the conductor receiving opening. These projecting portions provide lateral support for the multiconductor cable and also provide support for the rear walls of the housing halves.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENTS

Figure 1:
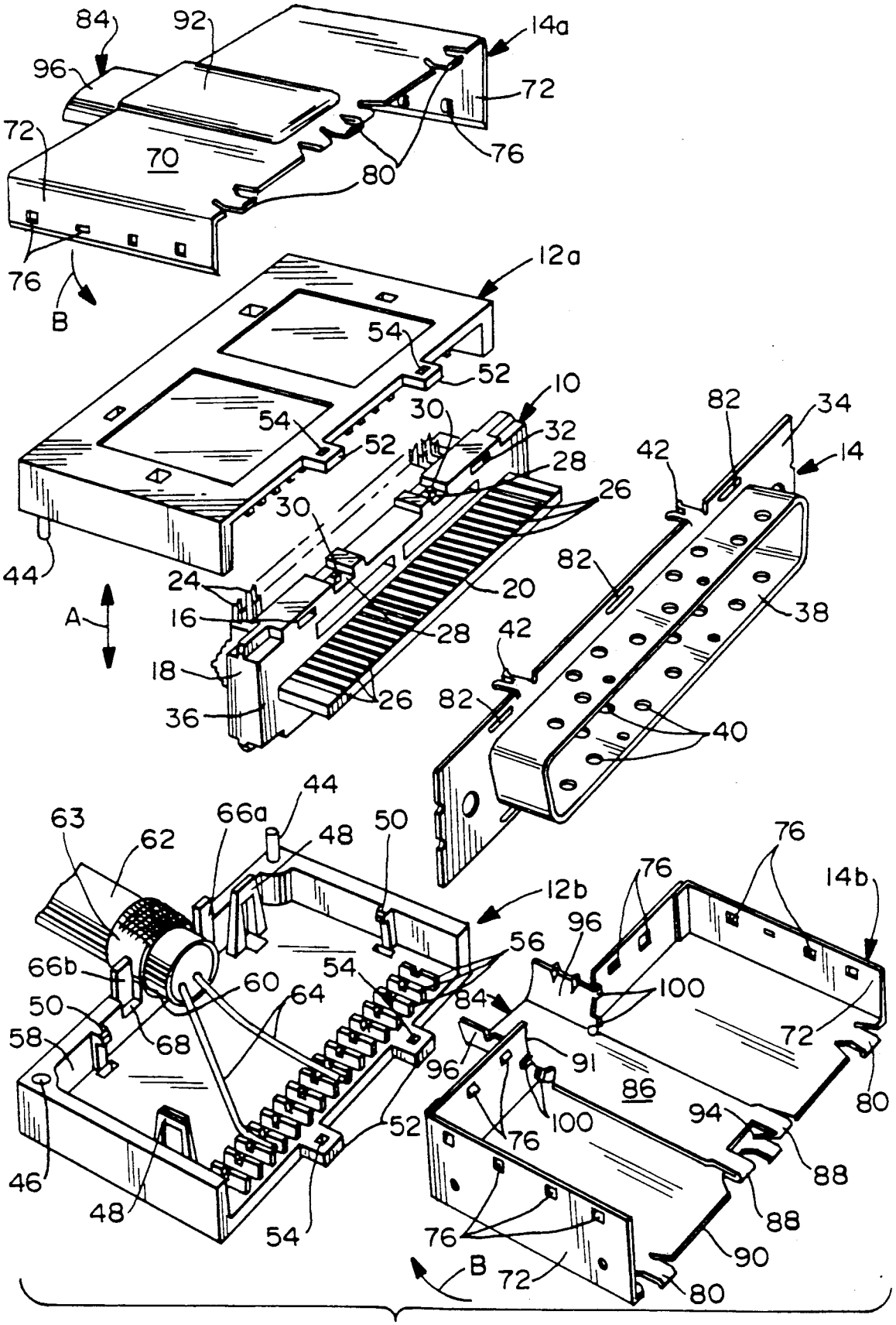
FIG. 1 is an exploded perspective view of a shielded electrical connector assembly incorporating the novel features of the invention.

Referring to the drawings in greater detail, and first to FIG. 1, the illustrated shielded electrical connector assembly includes insulating housing means formed of three components; namely, a dielectric body, generally designated 10, and a pair of housing halves, generally designated 12*a* and 12*b*; a stamped and formed metal shell, generally designated 14; and stamped and formed metal shield means including a pair of shield halves, generally designated 14*a* and 14*b*.

Housing body 10 can take a variety of configurations. The configuration shown includes a rear housing block 16, a peripheral flange 18 and a forwardly projecting table-like terminal positioning flange 20. In particular, referring to FIG. 2 in conjunction with FIG. 1, two pair of insulation displacement terminals 22*a* and 22*b* are shown oriented in opposite directions and including insulation displacement beams 24 and terminal contacts 26. The displacement beams 24 are at two levels and two rows creating a staggered orientation. A plurality of the insulation displacement beams are shown projecting upwardly from housing block 16 in FIG. 1, and a plurality of terminal contacts 26 are shown disposed in appropriate grooves on top of forwardly projecting flange 20 for mating with terminals of a complementary connector assembly (not shown).

Figure 2:
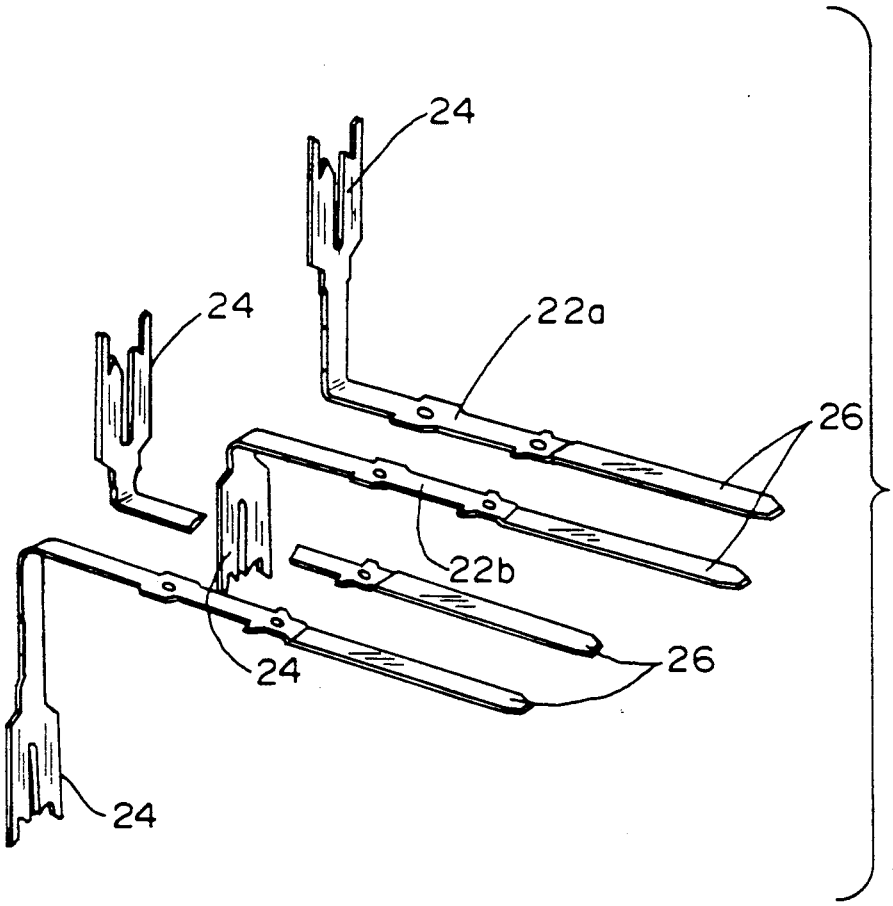
FIG. 2 is a perspective view of two pair of insulation displacement terminals incorporated in a staggered arrangement in the connector assembly.

It should be understood that although the top of housing body 10 is visible in FIG. 1, the bottom of the housing body is substantially identical to the top. That is why two insulation displacement terminals 22*a*, 22*b* are shown in FIG. 2 oriented in opposite directions. Both the top (visible in FIG. 1) and the bottom of peripheral flange 18 of housing body 10 have a pair of channels 28 with projecting pegs 30 in the channels (for purposes described hereinafter). In addition, a pair of passages 32 are formed in both the top and bottom of peripheral flange 18, again for purposes described hereinafter. The entire housing body 10 is integrally molded of plastic or other dielectric material.

Metal shell 14 includes a peripheral flange 34 for abutting against a front face 36 of housing body 10. A "D" shaped flange 38 projects forwardly of flange 34 of the shell for receiving a portion of the complementary connector assembly. D-shaped flange 38 has a plurality of dimples 40 stamped toward the inside thereof to provide an effective electrical interconnection with the shield of the complementary connector.

Metal shell 14 is assembled to housing body 10 by means of a pair of staking barbs 42 stamped and formed from the top and bottom edges of flange 34 for insertion in and interengagement with passages 32 at the top and bottom of peripheral flange 18 of the housing body.

Housing halves 12*a*, 12*b* are substantial mirror images of each other. In other words, the top or outside of housing half 12*a* is visible in FIG. 1, but the bottom outside of housing half 12*b* is substantially identical thereto. Likewise, the top inside of housing half 12*b* is visible in FIG. 1, but the bottom inside of housing half 12*a* is substantially identical thereto.

Each housing half 12*a*, 12*b* has a locating post 44 for positioning within a locating hole 46 of the opposite housing half to facilitate assembly. Each housing half 12*a*, 12*b* has a pair of latch fingers 48 and a pair of latch bosses 50. The latch fingers are somewhat flexible and the latch bosses are rigid with the surrounding walls of the housing halves.

After termination of the conductor 64 between the respective insulation displacement beams 24, the housing halves are moved toward each other in the direction of double-headed arrow "A" as they are guided by posts 44 into holes 46 and by projecting cantilevered support beams 66*a* contacting projecting cantilevered support beams 66*b* on the mating part, whereupon latch fingers 48 of each housing half snap into interengagement with latch bosses 50 of the opposite housing half.

In assembly, housing halves 12*a*, 12*b* are moved toward each other with housing body 10 sandwiched therebetween. Each housing half has a pair of forwardly protruding projections 52 with apertures 54 therethrough. Projections 52 seat in channels 28 in the top and bottom of peripheral flange 18 of the housing body, and pegs 30 in the channels engage apertures 54 in projections 52. This locates and secures the insulating housing means, including housing body 10 and housing halves 12*a*, 12*b* in assembled condition, as latch fingers 48 and latch bosses 50 hold the components in assembly.

Housing halves 12*a*, 12*b* can be termed conductor management blocks in that they include a plurality of laterally spaced ribs 56 defining conductor receiving troughs therebetween. Rear walls 58 of the housing halves include semicircular notches 60 which combine to define a circular opening for receiving a multiconductor cable 62. Individual conductors 64 (only two of which are shown in FIG. 1) extend from cable 62 and are positionable within the troughs defined by ribs 56. This locating means guides the conductors into the insulation displacement beams 24 of insulation displacement terminals 22*a*, 22*b*.

A feature of the invention contemplates the provision of projecting beams 66*a* and 66*b* on opposite sides of semicircular notch 60 on each housing half 12*a*, 12*b*. It can be seen in FIG. 1 that a cut-out 68 is formed at the base of beam 66*b*. A similar cut-out (which is not visible in FIG. 1) is formed on the rear side of beam 66*a*. Consequently, when housing halves 12*a*, 12*b* are assembled, the beams are positioned closely adjacent each other with the distal ends of the beams extending into cut-outs 68. The beams provide a dual function. First, they provide lateral support for cable 62, particularly during locating conductors 64 between ribs 56 and prior to assembly of the housing halves. Second, the beams also provide additional support for rear wall 58 of the housing halves when interengaged. In other words, through the beams, the rear wall of one housing half can provide additional support for the rear wall of the other housing half.

Shield halves 14*a*, 14*b* also are mirror images of each other. In other words, the outside top of shield half 14*a* is visible in FIG. 1, but the outside bottom of shield half 14*b* is substantially identical thereto. Likewise, the top inside of shield half 14*b* is visible in FIG. 1, but the bottom inside of shield half 14*a* is substantially identical thereto. Each shield half 14*a*, 14*b* includes a main transverse (top or bottom) wall 70, side walls 72 and a rear wall 74 combining to form a generally rectangular configuration. The side walls and the rear wall include projecting detent and aperture means 76 stamped and formed from the metal thereof to provide a snapping interengagement of the shield halves when pivoted together in the direction of the arrows "B" after cantilevered tabs 80 are inserted into slots 82. The shield halves are sized or dimensioned to substantially cover housing halves 12*a*, 12*b* when they are assembled as described above. In assembly, each shield half is provided with hooked cantilevered tabs 80 which interengage with slots 82 in peripheral flange 34 of metal shell 14 after the assembled shield halves are pivoted in the direction of arrows "B". Shield halves 14*a*, 14*b* are fabricated of stamped and formed metal material.

The invention contemplates a novel cable clamping means, generally designated 84, on each shield half 14*a*, 14*b* which, when assembled, forms a crimp barrel for crimping onto a braided shield or ground (not shown) of multiconductor cable 62. As stated above, the shield means or crimp barrel forms a stamped and formed clamping means which does not have the disadvantages of prior drawn crimp barrels.

More particularly, a front-to-rear elongated tongue 86 (see shield half 14*b*) is stamped and formed integrally with each shield half and is bent, as at 88, from a front edge 90 of wall 70, with the tongue being folded rearwardly inside the wall toward and through a semicircular opening 91 in the rear wall 74 of each shield half. It can be seen by shield half 14*a*, that wall 70 is stamped with an outwardly projecting trough 92 so that tongue 86 lies substantially flush with the inside surface of wall 70. The tongue of each shield half (see shield half 14*b*) is provided with a cut-out 94 to accommodate the center hooked cantilevered tab 80 which interengages with metal shell 14.

Cable clamping means 84 is stamped and formed at the distal end of tongue 86 as best seen by shield half 14*b*. Specifically, the distal end of each tongue 86 is enlarged and curved, as at 96, to form one-half or semicylindrical portion of a composite crimp barrel disposed rearwardly or on the outside of rear wall 74 of the respective shield half. In other words, the stamped and formed semicylindrical shape at the distal ends of the respective tongues of shield halves 14*a*, 14*b* abut in an edge-wise manner to form an enclosed crimp barrel. The crimp barrel, being stamped and formed from the same metal sheet as the entirety of the shield halves, therefore can have a uniform thickness, and thereby afford a rectangular configuration for the shield halves as described above in the Background. Once the shield halves are interconnected about the assembled housing halves 12*a*, 12*b*, the crimp barrel can be crimped onto the braid of cable 62 which is wrapped around and supported by cylindrical ferrule 63, and the crimped area can extend throughout the barrel.

Again as visible with shield half 14*b*, a plurality of tabs 100 are stamped from the metal material of each shield half at the forward edge (when formed as shown in FIG. 1) of cable clamping means 84. These tabs are bent transversely outwardly into engagement with the inside surface of rear wall 74. The tabs provide additional shielding in the void between semicircular opening 91 in rear wall 74 and the outer surface of the crimped barrel. In addition, the tabs provide additional support for the crimp barrel and direct contact circumferentially about the crimp barrel with rear wall 74 which forms an integral portion of the main structure of the integral shield halves.

Figure 3:
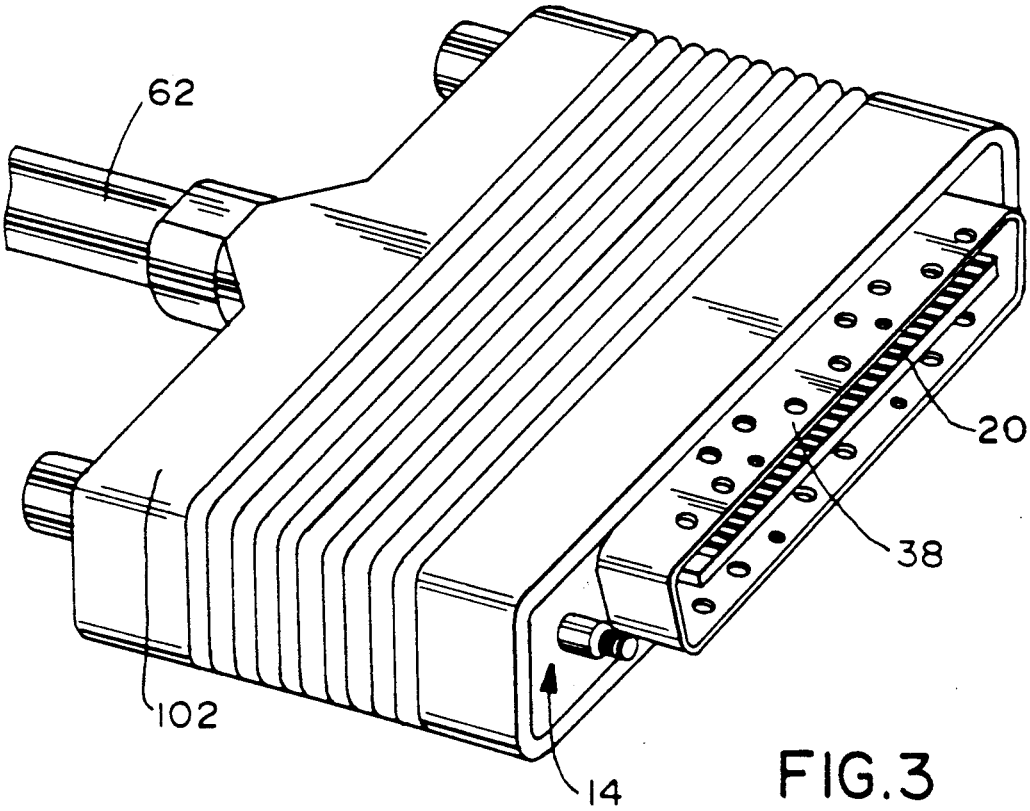
FIG. 3 is a perspective view of the electrical connector assembly having been overmolded with a plastic covering.

After connector components 10, 12*a*, 12*b*, 14, 22*a* and 22*b* are assembled as described above, shield halves 14*a* and 14*b* are assembled over the housing components, and cable clamping means 84 are crimped onto cable 62, an overmold 102 (FIG. 3) is molded over the assembly in a generally rectangular configuration.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector assembly, comprising:

insulating housing means having a front mating end and a rear conductor receiving end for a multiconductor cable;

stamped and formed metal shield means about at least the rear conductor receiving end of the insulating housing; and cable clamping means at a rear end of the metal shield means integral therewith and formed by metal of the shield means folded rearwardly from a point remote from the rear end thereof.

2. The shielded electrical connector assembly of claim 1 wherein said cable clamping means is generally cylindrical.

3. The shielded electrical connector assembly of claim 1 wherein said metal shield means comprise a pair of interengageable shield halves each having a metal portion folded rearwardly and combining to form said cable clamping means.

4. The shielded electrical connector assembly of claim 3 wherein a distal end of the folded portion of each shield half is semicylindrical to combine and form the cable clamping means in a generally cylindrical configuration.

5. The shielded electrical connector assembly of claim 1 wherein said shield means has a front end, and said cable clamping means is formed by metal folded rearwardly from said front end.

6. The shielded electrical connector assembly of claim 5 wherein said shield means has a rear wall and said cable clamping means projects through an opening in the rear wall.

7. The shielded electrical connector assembly of claim 6, including support tabs bent transversely outwardly from the cable clamping means against an inside surface of the rear wall.

8. The shielded electrical connector assembly of claim 5 wherein said rearwardly folded metal is in the form of a tongue located inside a wall of the shield means, the tongue terminating at a rear distal end in the cable clamping means.

9. The shielded electrical connector assembly of claim 8 wherein said wall has an outwardly projecting recess to accommodate said tongue so that the tongue lies flush with an inside surface of said wall.

10. The shielded electrical connector assembly of claim 5 wherein said cable clamping means is generally cylindrical.

11. The shielded electrical connector assembly of claim 1 wherein said metal shield means is substantially rectangular in configuration.

12. A shielded electrical connector assembly, comprising:

insulating housing means having a front mating end and a rear conductor receiving end for a multiconductor cable;

a pair of interengageable shield halves about at least the rear conductor receiving end of the insulating housing, the shield halves each having a front end and a rear end; and cable clamping means at the rear end of each metal shield half integral therewith and formed by metal folded rearwardly from the front end thereof beyond the rear end thereof, the cable clamping means of the two shield halves combining to form a composite crimp barrel.

13. The shielded electrical connector assembly of claim 12 wherein the cable clamping means of each shield half is semicylindrical to combine and form a generally cylindrical crimp barrel.

14. The shielded electrical connector assembly of claim 13 wherein each shield half has a rear wall and said cable clamping means projects through an opening in the rear wall.

15. The shielded electrical connector assembly of claim 14, including support tabs bent transversely outwardly from the cable clamping means against an inside surface of the rear wall.

16. The shielded electrical connector assembly of claim 12 wherein said rearwardly folded metal is in the form of a tongue located inside a wall of each shield half, the tongue terminating at a rear distal end in the cable clamping means.

17. The shielded electrical connector assembly of claim 16 wherein said wall has an outwardly projecting recess to accommodate said tongue so that the tongue lies flush with an inside surface of said wall.

18. The shielded electrical connector assembly of claim 12 wherein said cable clamping means of each shielded half is generally cylindrical.

19. The shielded electrical connector assembly of claim 12 wherein each shield half is substantially rectangular in configuration.

20. An electrical connector assembly, comprising:

insulating housing means formed by a pair of interengageable housing halves, the housing means having a rear conductor receiving opening; and each of said housing halves having a cantilevered support beam on each side of said opening, projecting toward the other housing half to provide lateral support for a conductor extending through said opening.

21. The electrical connector assembly of claim 20 wherein the support beams of said housing halves on each respective side of said opening are positioned in abutment with each other to provide engaging support between the housing halves.

* * * * *